United States Patent [19]

Rich et al.

[11] 4,329,808

[45] May 18, 1982

[54] PAPER-AIRPLANE-MAKING AND LAUNCHING DEVICE

[75] Inventors: Hubert A. Rich, Westminster; Gary M. Saffer, Torrance; John C. Woolington, Harbor City, all of Calif.

[73] Assignee: Mattel, Inc., Hawthorne, Calif.

[21] Appl. No.: 227,570

[22] Filed: Jan. 22, 1981

[51] Int. Cl.[3] ..... A63H 27/14

[52] U.S. Cl. ..... 46/81; 46/1 R; 493/959; 493/334; 493/379

[58] Field of Search ..... 46/39, 74 R, 81, 1 R, 46/76 R, 44; 156/226, 227, 475, 579, 556, 580, 187; 493/379, 382, 374, 393, 334, 344, 959; 273/416–422; 124/60, 64

[56] References Cited

U.S. PATENT DOCUMENTS

| | | | |
|---|---|---|---|
| 561,814 | 6/1896 | Remus | 493/457 |
| 2,285,447 | 6/1942 | Lichter | 493/382 X |
| 2,315,242 | 3/1943 | Briggs et al. | 46/81 |
| 2,890,044 | 6/1959 | Wilson | 270/79 |
| 3,733,737 | 5/1973 | Goodman | 46/79 |
| 3,749,623 | 7/1973 | Benoit | 156/227 X |
| 3,901,501 | 8/1975 | Kistner | 270/62 |
| 3,946,519 | 3/1976 | Vadik et al. | 46/79 |

*Primary Examiner*—Robert Peshock
*Assistant Examiner*—Mickey Yu
*Attorney, Agent, or Firm*—Ronald M. Goldman; Max E. Shirk; Roy A. Ekstrand

[57] ABSTRACT

A tubular member holds a paper, tubular fuselage above a paper wing supported by a plate and below a folding die from which a fuselage presser depends; whereby the fuselage may be attached to the wing and the edges of the wing may be folded into an aerodynamic configuration when the die and tubular member are brought into working association with a pair of upstanding plates which are spaced apart in a manner such that the fuselage and its associated parts may be positioned between said plates while said die folds the wing edges over the upper edges of the plates.

8 Claims, 8 Drawing Figures

82
80
32
24
28
10
126
88
12
34
88
86
154
30
87
155
48
26
132
158
158
150
42
44
46
90

126
10
74
154
156
158
155
30
153
150
156
28
70
158
72
50
26
48
90
102
42
44
24
52
32
46
92
96,100
94,98

87
80
82
88
86
30
14
86
88
12
24
126
130
128
136
74
72
22
30
18
82
20
38
142
138
140
28
10
62
76
80
16
66
12
36
24
34
40
14
56
32
122
64
70
50
52
46
26
46
54
118
58
48
132
48
44
42
60
134
120
114
146
124
104
106
98
110
108
92
112
102
94
124
100
116
90
96
102

10
12
18
20
22
24
26
28
30
31
32
34
36
48
50
52
60
68
70
72
74
78
82
84
86
90
92
94
98
104
114
120
124
126
132
136
138
140
142

7
7
10
12
18
20
22
24
26
28
30
31
32
34
36
48
50
52
60
68
70
72
74
82
84
86
87
90
92
114
120
124
126
132
136
138
140
142

PAPER-AIRPLANE-MAKING AND LAUNCHING DEVICE

BACKGROUND OF THE INVENTION

1. Field of the Invention

The present invention relates generally to the field of paper folding devices and more particularly to a new and useful paper-airplane-making device.

2. Brief Description of the Prior Art

The prior art known to applicants is of-record in separate communications to the United States Patent and Trademark Office. The present invention exemplifies improvements over this prior art.

SUMMARY OF THE INVENTION

The present invention is directed, in brief, to the provision of a device for making paper airplanes of the type having a wing, a tubular fuselage, which is closed at one end, and a suitable adhesive or the like for attaching the fuselage to the wing. The device may also include an air pump for launching the airplane.

The best mode currently contemplated for carrying out the invention includes the provision of a holder for the fuselage, a support for supporting the wing adjacent the fuselage with the adhesive in juxtaposition with the fuselage, an apparatus for pressing the fuselage against the adhesive and a folder for folding the wing into an aerodynamic configuration.

The features of the present invention which are believed to be novel are set forth with particularity in the appended claims. The present invention, both as to its organization and manner of operation, together with further objects and advantages thereof, may best be understood by reference to the following description, taken in connection with the accompanying drawing in which like reference characters refer to like elements in the several views.

DESCRIPTION OF THE PREFERRED EMBODIMENT

Figure 1:
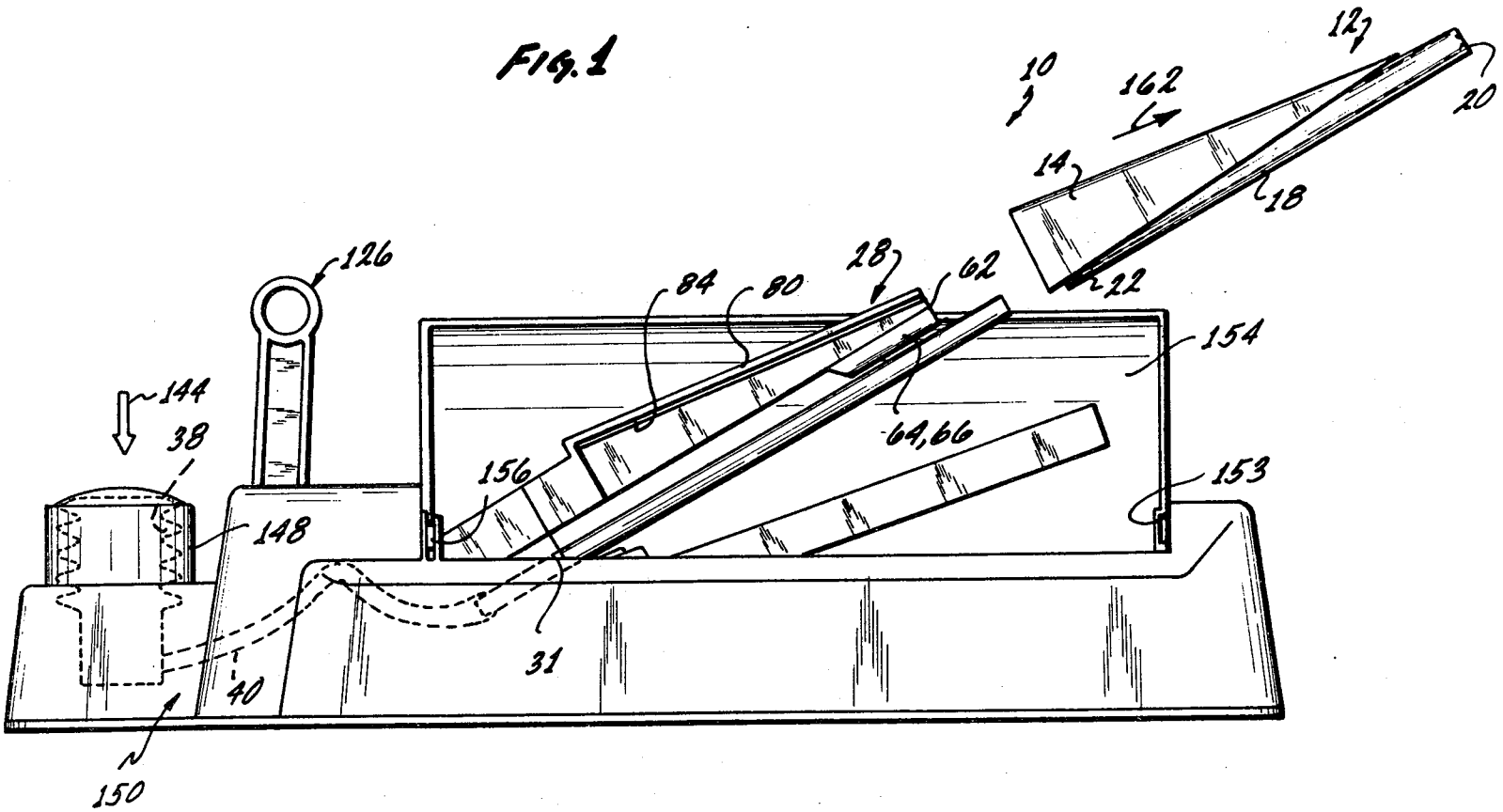
FIG. 1 is a side-elevational view of a device for making and launching paper airplanes constituting a presently-preferred embodiment of the invention and showing the device during the launching of a paper airplane.
Figure 2:
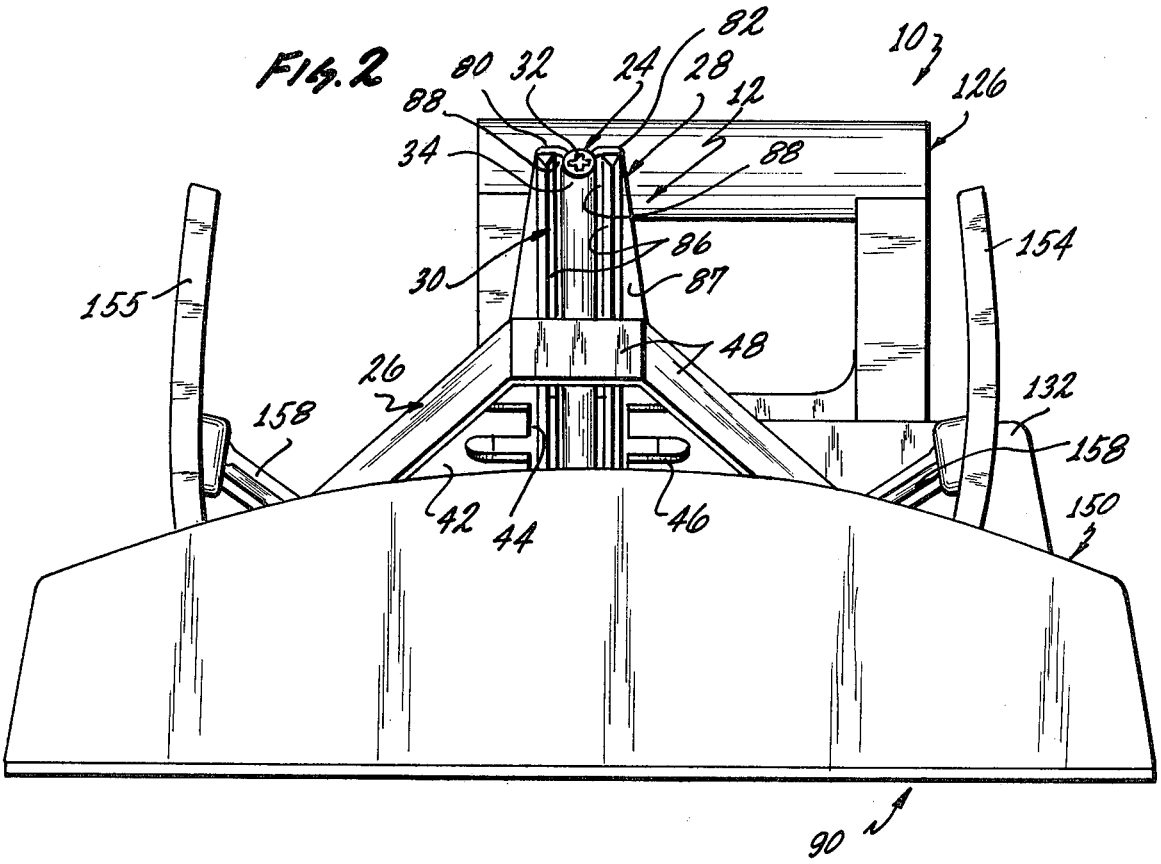
FIG. 2 is a front-elevational view of the device of FIG. 1.
Figures 3, 8:
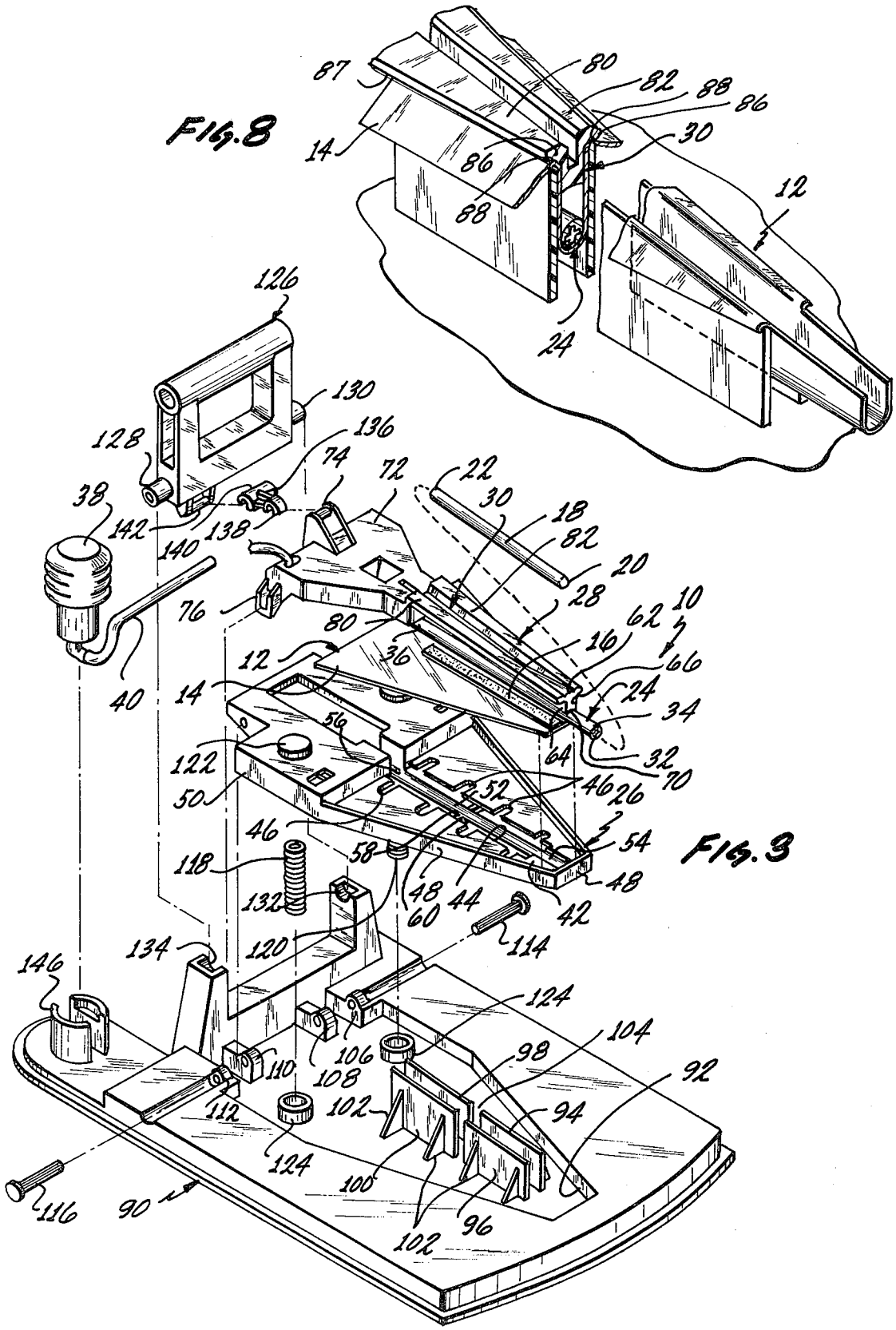
FIG. 3 is a reduced, partial exploded perspective view of the device of FIG. 1.
FIG. 8 is an enlarged, partial perspective view of the wing-folding mechanism.

Referring again to the drawings and more particularly to FIGS. 1, 2 and 3, a paper-airplane-making device constituting a presently-preferred embodiment of the present invention, generally designated 10, may be used for making and launching a paper airplane 12 including a wing 14 (FIG. 3) having a strip of adhesive 16 provided thereon, and a hollow, tubular fuselage 18, having a closed end 20 and an open end 22.

Device 10 includes a hollow, tubular holder 24 for holding fuselage 18, a support 26 for supporting wing 14 adjacent fuselage 18 with adhesive strip 16 in juxtaposition with fuselage 18, an apparatus or presser 28 for pressing fuselage 18 against adhesive 16 and a die or folder 30 for folding wing 14 into an aerodynamic configuration.

Holder 24, which is affixed to folder 30 by a bracket 31, may be molded from a suitable polymeric material, has a cylindrical shape and a cruciform bore 32 and includes a first open end 34 and a second open end 36. The cruciform shape of bore 32 minimizes the likelihood that a child user will propel a projectile from holder 24 by applying a blast of air to end 36 which is connected to an air pump 38 by a conduit 40.

Figure 7:
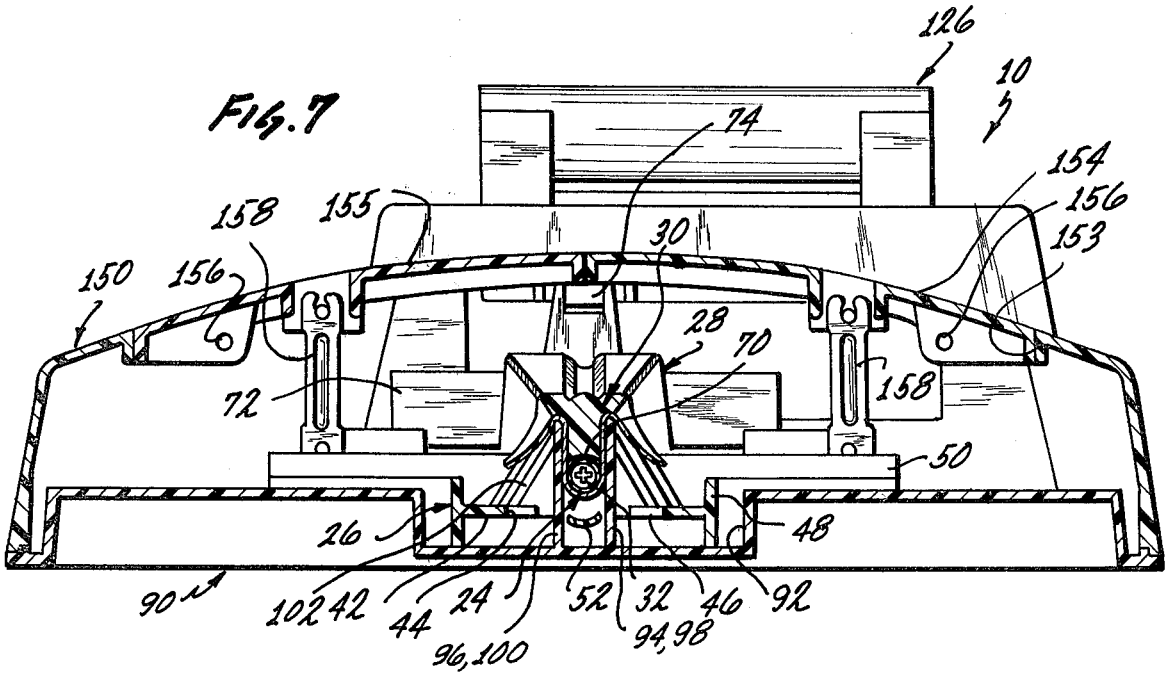
FIG. 7 is a cross-sectional view taken along line 7—7 of FIG. 6.
Figure 5:
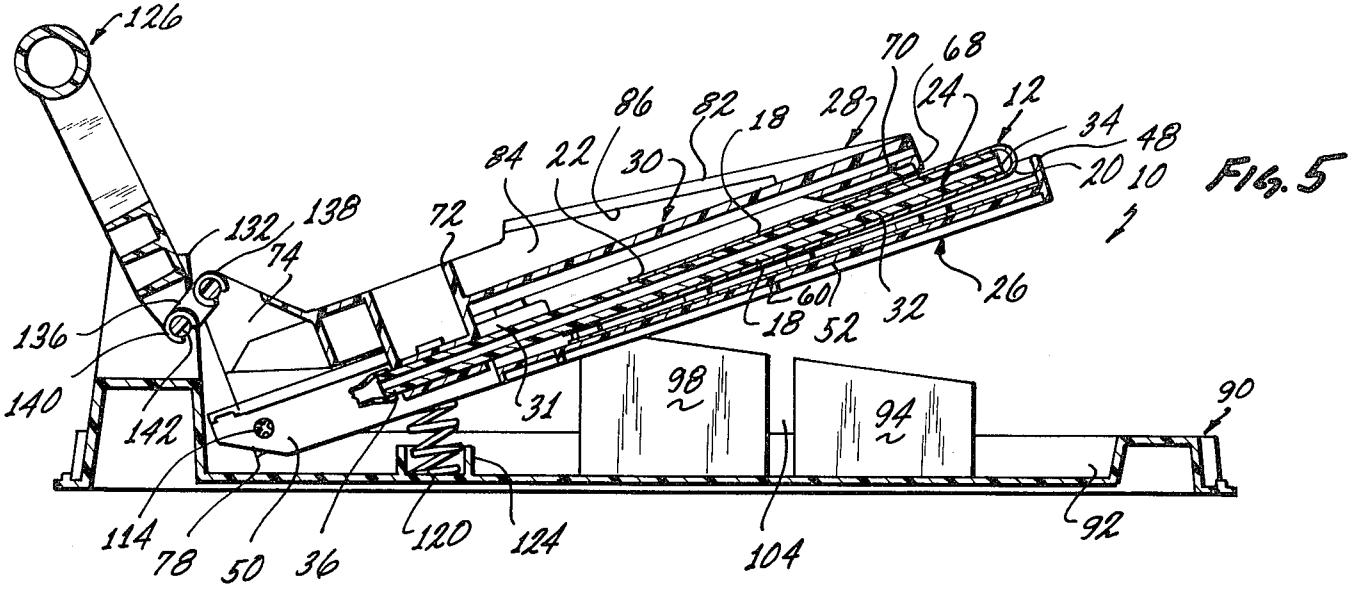
FIG. 5 is a longitudinal, partial cross-sectional view of the device of FIG. 1 showing a paper fuselage and wing in position preparatory to a wing-folding operation.

Referring to FIGS. 3, 5 and 7, support 26 includes a plate 42 provided with an elongated slot 44 communicating with a plurality of U-shaped openings 46. Plate 42 may be molded from suitable polymeric materials and is formed integrally with an encompassing sidewall 48, a plate carrier 50, and a semi-cylindrical rib or trough 52 having front and rear ends 54, 56, respectively, formed by cavities in plate 42 along the major axis thereof and an intermediate portion 58 supported in slot 44 by a bracket 60 depending from plate 42 and extending along its minor axis between the depending portions of sidewall 48.

Apparatus or presser 28 may be formed integrally with folder 30 at a first end 62 thereof and includes a pair of flanges 64, 66 depending from end 62 in suitable spaced relationship so that end 34 of holder 24 may be craddled by flanges 64, 66 for moving holder 24 downwardly when presser 28 is moved downwardly. Flanges 64, 66 are preferably reinforced by a bracket 68 having a U-shaped lower edge 70.

Folder 30 may also be molded from a suitable polymeric material and is formed integrally with a mount 72 having a toggle bracket 74 and a pair of U-shaped mounting brackets 76, 78 provided thereon. Folder 30 includes a pair of plates 80, 82 each reinforced by a gusset 84 and each carrying a rib 86 on its lower surface 87. Each rib 86 is spaced slightly from its associate gusset 84 whereby a groove 88 is formed in the lower surface 87.

Referring now to FIGS. 3, 4, 5 and 7, device 10 also includes a base 90 provided with a recess 92 which accomodates support 26 in its lowermost position. Front and rear pairs of upright, spaced-apart plates 94, 96 and 98, 100, respectively, are affixed to base 90 in recess 92 by a plurality of brackets 102. A space 104 is provided between the front and rear sets of plates to accomodate bracket 60 on support 26 when the support is in its lowermost position in recess 92. First and second pairs of apertured mounting lugs 106, 108 and 110, 112 (FIG. 3), respectively, may be formed integrally with base 90 during the molding thereof from a suitable polymeric material, whereby support 26 and folder 30 may be pivotally mounted to base 90 by a pair of pivots 114, 116. Support 26 may then be biased to the position shown on FIGS. 1, 4 and 5 by a pair of compression springs 118, 120 (FIG. 3) each trapped between an upper hollow boss 122 on plate carrier 50 and a lower hollow boss 124 in recess 92.

Figure 4:
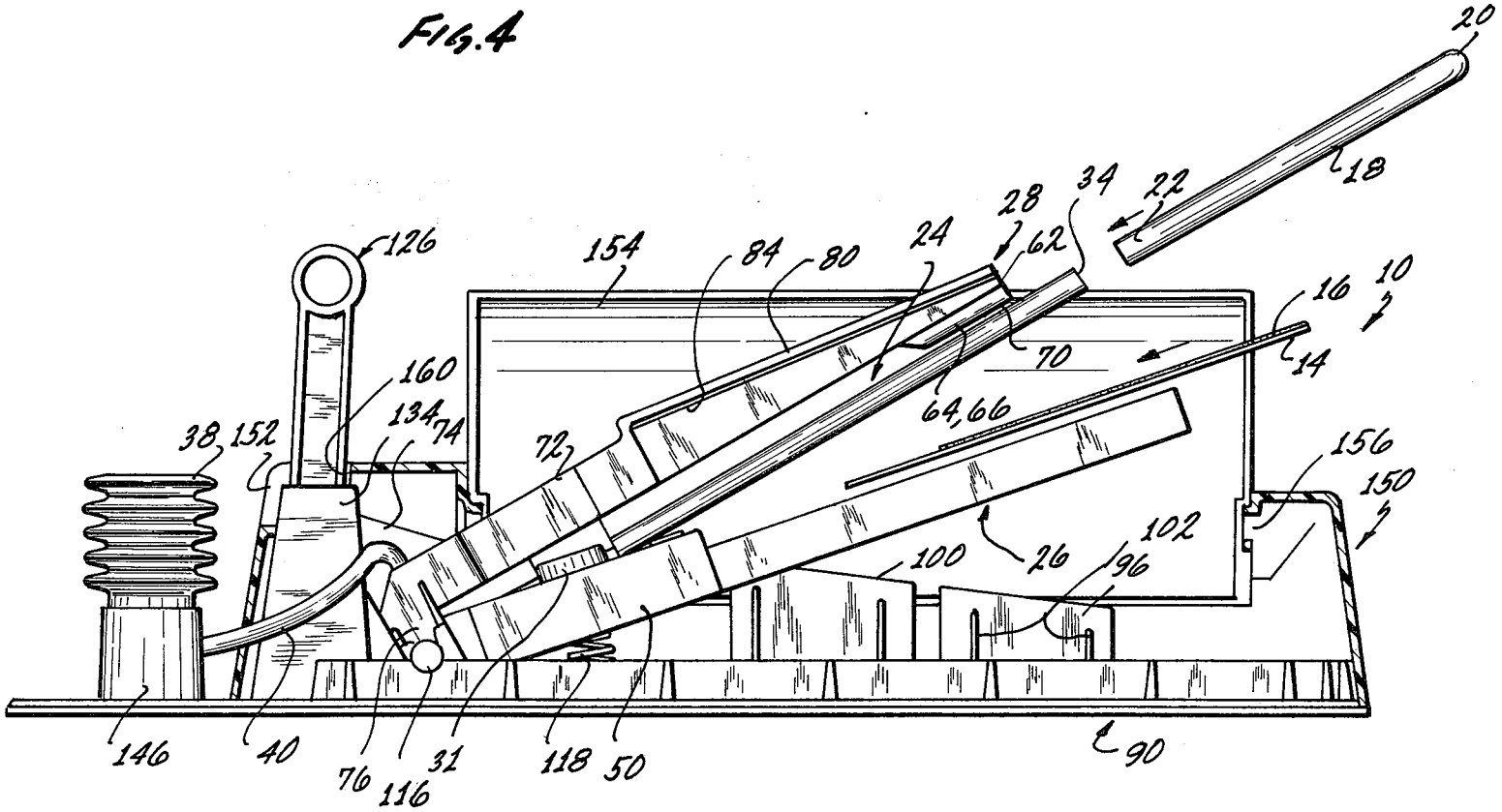
FIG. 4 is a view similar to that of FIG. 1 with parts broken away to show internal construction and showing the device during a loading operation.
Figure 6:
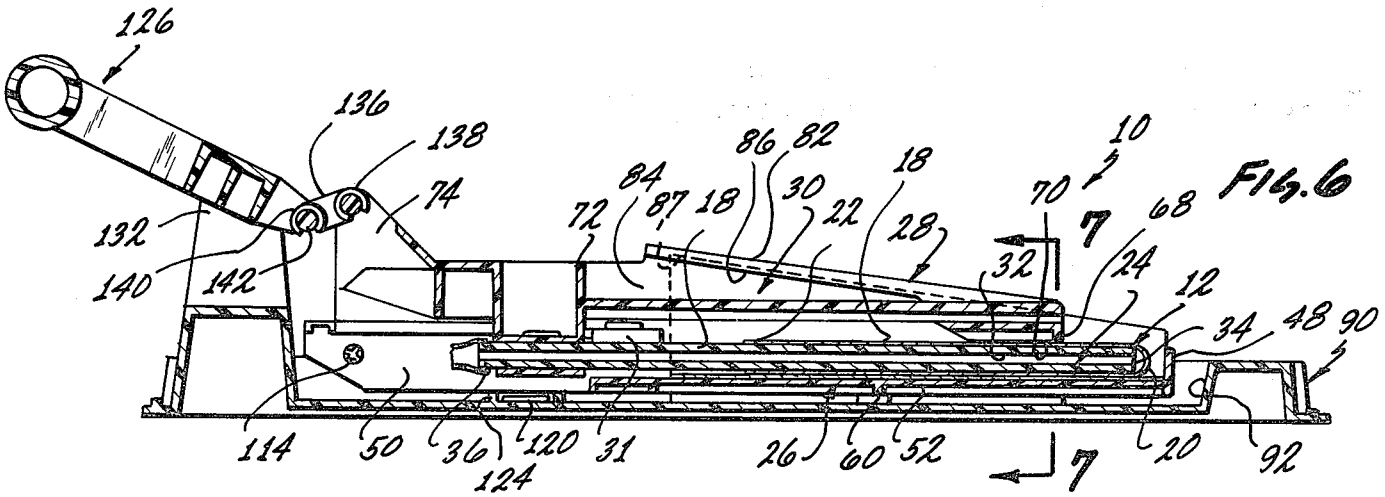
FIG. 6 is a view similar to FIG. 5 showing the relative positions of the parts during the folding operation.

Folder 30 may be swung to the different positions shown in FIGS. 4, 5 and 6 by manipulating a handle 126 having a pair of wrist pins 128, 130 (FIG. 3) pivotally mounted to base 90 by trunnions 132, 134 respectively. Handle 126 is coupled to folder 30 by a toggle 136 having a first end 138 connected to toggle bracket 74 on mount 72 and a second end 140 connected to a toggle bracket 142 depending from handle 126.

When handle 126 is in the position shown in FIG. 4, there is sufficient clearance between presser 28 and holder 24 to permit loading fuselage 18 onto holder 24. Wing 14 may then be loaded onto support 26 with adhesive strip 16 uppermost. When handle 126 is then moved counterclockwise or rearwardly to its FIG. 5 position, presser 28 forces fuselage 18 into engagement with adhesive strip 16 causing the underlying portion of wing 14 to be craddled by rib 52 against the bias of springs 118, 120, whereby fuselage 18 becomes affixed to wing 14. Handle 126 may then be swung rearwardly to its FIG. 6 position so that folder 30 will fold wing 14 over plates 94, 96, 98, 100 into an aerodynamic configuration. When handle 126 is swung clockwise back to its FIG. 4 position, airplane 12 may be launched by actuating air pump 38, as indicated by arrow 144 in FIG. 1.

As best shown in FIG. 3, airpump 38 may be mounted in a split, cylindrical cage 146 formed integrally with base 90 during the molding operation. A cap 148 (FIG. 1) may be used to cover pump 38 and is reciprocally mounted in a housing 150 mounted on base 90. Housing 150 is provided with a pair of depending lugs, like the one shown at 152 in FIG. 4, which engage wrist pins 128, 130 for retaining them on their trunnions.

Referring now to FIGS. 1, 4 and 7, housing 150 is provided with an opening 153 in which a pair of doors 154, 155 are swingably mounted by pivots 156. Each door is coupled to carrier 50 on support 26 by a link 158 (FIG. 7) for automatically opening and closing doors 154, 155 when handle 126 is manipulated.

Operation of device 10 is believed to be apparent from the foregoing and will be briefly summarized at this point. Handle 126 may be moved to its upright position against a stop 160 (FIG. 4) on housing 150 opening doors 154, 155 (FIG. 2) and elevating folder 30, holder 24 and support 26. Fuselage 18 and wing 14 may then be loaded into device 10 whereupon handle 126 may be swung counterclockwise to the position shown in FIG. 6 closing doors 154, 155 and causing presser 28 to attach fuselage 18 to adhesive strip 16 and push fuselage 18 and wing 14 down between plates 94, 96, 98 and 100 to the position shown in FIGS. 7 and 8. Simultaneously, the edges of wing 14 will be folded over the upper edges of plates 94, 96, 98 and 100 by ribs 86 and grooves 88 on plates 80, 82. Handle 126 may then be swung clockwise to its upright position for opening doors 154, 155 and elevating holder 24 to its FIG. 1 position whereupon pump 38 may be actuated forcing air through conduit 40 and holder 24 to launch airplane 12 in the direction of arrow 162.

While the particular paper-airplane-making device herein shown and described in detail is fully capable of attaining the objects and providing the advantages hereinbefore stated, it is to be understood that it is merely illustrative of the presently preferred embodiment of the invention and that no limitations are intended to the details of construction or design herein shown other than defined in the appended claims, which form a part of this disclosure.

Whenever the term "means" is employed in these claims, this term is to be interpreted as defining the corresponding structure illustrated and described in this specification or the equivalent of the same.

What is claimed is:

1. A device for making paper airplanes of the type including a wing, a tubular fuselage, and means for connecting said wing and said fuselage together, said device comprising:

means for holding said fuselage, said holding means comprising a tubular member;

means for supporting said wing adjacent said holding means with said connecting means in juxtaposition with said fuselage;

means for pressing said fuselage against said connecting means and for folding said wing into an aerodynamic configuration;

an air pump; and means connecting said air pump to said tubular member for launching said airplane.

2. A device as recited in claim 1 wherein said supporting means comprises a platform having an elongated trough provided therein, said trough being dimensioned such that said holding means may push said fuselage and the portion of said wing which carries said connecting means into assembled relationship on said trough.

3. A device as recited in claim 2 wherein said pressing means comprises:

a folding die overlying said holding means, said die being provided with a pair of elongated grooves;

a pair of space-apart upstanding plates underlying said elongated grooves, whereby said holding means may pass between said upstanding plates and said grooves may fold the edges of said wing over said upstanding plates; and means connected to said die for swinging said die into engagement with said upstanding plates.

4. A device for folding and launching paper airplanes of the type which include a wing having a layer of adhesive thereon and a hollow tubular fuselage having a closed end and an open end, said device comprising:

first means for receiving said fuselage, said first means being hollow and having first and second ends, said fuselage being mounted on said first means by inserting said open end of said fuselage over one of said first and second ends of said first means and sliding said fuselage toward the other of said first and second ends;

an air pump connected to said other of said first and second ends of said first means;

second means for supporting said wing adjacent said first means with said adhesive layer in juxtaposition with said fuselage;

third means for pressing said fuselage against said adhesive layer and folding said wing into an aerodynamic configuration; and fourth means for moving said first means into launching position, whereby said airplane may be launched by actuating said pump.

5. A device for making paper airplanes of the type having a wing, a tubular fuselage and means for connecting said fuselage to said wing, said device comprising;

a base having a major axis and a minor axis;

a pair of plates affixed to said base in upstanding, spaced-apart relationship with the major axis of said upstanding plates parallel to the major axis of said base;

a paper support for supporting said wing, said paper support having an elongated slot provided therein and a trough mounted in said slot;

means for swingably mounting said paper support to said base with said slot registering with said upstanding plates, whereby said paper support may be swung to a first position wherein said upstanding plates extend upwardly through said slot with said trough positioned between upstanding plates and a second position wherein said slot and said trough are above said upstanding plates;

a paper-folding die having a pair of elongated grooves provided therein;

a tubular member affixed to the underside of said die for holding said fuselage;

means for pivotably mounting said die to said base with said grooves overlying said slots and said upstanding plates and with said tubular member overlying said trough whereby said tubular member and said die may be swung downwardly to connect said fuselage to said wing, by pressing said wing against said trough to force the central portion of said wing down between said upstanding plates and to cause each of said grooves to fold an associated edge of said wing down over the upper edge of an associated one of said upstanding plates;

a handle pivotably mounted to said base; and means coupling said handle to said die for operating said die.

6. A device as recited in claim 5 including:

an air pump;

a conduit connecting said air pump to said tubular member; and means for mounting said air pump to said base.

7. A device as recited in claim 6 including means for bracing said trough into a predetermined elevated position.

8. A device as recited in claim 5 including:

a housing encompassing said base, said housing having an open top;

a pair of doors pivotally mounted to said housing in said open top; and a link connecting each of said doors to said paper support for opening and closing said doors by movement of said paper support.

* * * * *